US010665443B2

(12) United States Patent
Ibrahim et al.

(10) Patent No.: US 10,665,443 B2
(45) **Date of Patent: *May 26, 2020**

(54) DEVICE TO MANIPULATE IONS OF SAME OR DIFFERENT POLARITIES

(71) Applicant: Battelle Memorial Institute, Richland, WA (US)

(72) Inventors: Yehia M Ibrahim, Richland, WA (US); Richard D. Smith, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/289,216

(22) Filed: Feb. 28, 2019

(65) Prior Publication Data

US 2019/0198305 A1 Jun. 27, 2019

Related U.S. Application Data

(63) Continuation of application No. 15/260,046, filed on Sep. 8, 2016, now Pat. No. 10,224,194.

(51) Int. Cl.

| | |
|---|---|
| ***H01J 49/00*** | (2006.01) |
| ***H01J 49/06*** | (2006.01) |
| ***H01J 49/42*** | (2006.01) |

(52) U.S. Cl.

CPC ..... *H01J 49/0095* (2013.01); *H01J 49/062* (2013.01); *H01J 49/063* (2013.01); *H01J 49/065* (2013.01); *H01J 49/4235* (2013.01)

(58) Field of Classification Search

CPC ..... H01J 49/062; H01J 49/065; H01J 49/422; H01J 49/4235; H01J 49/0095

See application file for complete search history.

(56) References Cited

U.S. PATENT DOCUMENTS 5,572,035 A 11/1996 Franzen
6,107,328 A 8/2000 Parsons
(Continued)

FOREIGN PATENT DOCUMENTS

EP 1 566 828 A2 8/2005
EP 1 825 495 B1 11/2011
(Continued)

OTHER PUBLICATIONS

Ibrahim et al., "New frontiers for mass spectrometry based upon structures for lossless ion manipulations," The Analyst, 142(7):1010-1021 (Mar. 3, 2017).

(Continued)

*Primary Examiner* — Wyatt A Stoffa
(74) *Attorney, Agent, or Firm* — Klarquist Sparkman, LLP

(57) ABSTRACT

An apparatus includes a first pair of opposing electrode arrangements that confine ions between them in a portion of a confinement volume inwardly laterally in a first confinement direction with respect to a longitudinal ion propagation direction, each opposing electrode arrangement including an arrangement of RF electrodes situated to receive an unbiased RF voltage having an alternate phase between adjacent RF electrodes of the arrangement of RF electrodes so as to provide the confining of ions between the first pair of opposing electrode arrangements, and a second pair of opposing electrode arrangements that confine the ions between the second pair in the confinement volume inwardly laterally in a second confinement direction that complements the first confinement direction, each opposing electrode arrangement of the second pair including an arrangement of RF electrodes that receive an unbiased RF voltage having an alternate phase between adjacent RF electrodes.

19 Claims, 13 Drawing Sheets

(56) References Cited

U.S. PATENT DOCUMENTS

| | | | | |
|---|---|---|---|---|
| 6,369,383 | B1 | 4/2002 | Cornish et al. | |
| 6,960,760 | B2 | 11/2005 | Bateman et al. | |
| 7,365,317 | B2 | 4/2008 | Whitehouse et al. | |
| 7,391,021 | B2 | 7/2008 | Stoermer et al. | |
| 7,786,435 | B2 | 8/2010 | Whitehouse et al. | |
| 7,838,826 | B1 | 11/2010 | Park | |
| 7,888,635 | B2 | 2/2011 | Belov et al. | |
| 8,049,169 | B2 | 11/2011 | Satake et al. | |
| 8,067,747 | B2 * | 11/2011 | Wollnik | H01J 49/062 250/281 |
| 8,222,597 | B2 | 7/2012 | Kim et al. | |
| 8,637,817 | B1 * | 1/2014 | Krutchinsky | H01J 49/424 250/293 |
| 8,835,839 | B1 | 9/2014 | Anderson et al. | |
| 8,969,800 | B1 | 3/2015 | Tolmachev et al. | |
| 9,184,040 | B2 * | 11/2015 | Park | H01J 49/063 |
| 9,324,548 | B1 | 4/2016 | Benter et al. | |
| 9,704,701 | B2 * | 7/2017 | Ibrahim | H01J 49/26 |
| 10,224,194 | B2 * | 3/2019 | Ibrahim | H01J 49/0095 |
| 10,460,920 | B1 * | 10/2019 | Smith | H01J 49/065 |
| 2001/0035498 | A1 * | 11/2001 | Li | H01J 49/062 250/398 |
| 2004/0026611 | A1 | 2/2004 | Bateman et al. | |
| 2007/0138384 | A1 | 6/2007 | Keiser | |
| 2009/0026361 | A1 * | 1/2009 | Syms | H01J 3/14 250/281 |
| 2009/0134321 | A1 * | 5/2009 | Hoyes | C08L 23/04 250/282 |
| 2009/0173880 | A1 * | 7/2009 | Bateman | H01J 49/065 250/292 |
| 2009/0206250 | A1 * | 8/2009 | Wollnik | G01N 27/622 250/290 |
| 2011/0024618 | A1 * | 2/2011 | Brown | H01J 49/065 250/283 |
| 2011/0049346 | A1 * | 3/2011 | Wells | H01J 49/04 250/282 |
| 2011/0049357 | A1 | 3/2011 | Giles | |
| 2011/0192969 | A1 | 8/2011 | Verentchikov | |
| 2012/0261570 | A1 | 10/2012 | Shvartsburg et al. | |
| 2012/0305758 | A1 * | 12/2012 | Park | H01J 49/063 250/282 |
| 2013/0175440 | A1 * | 7/2013 | Perelman | H01J 49/067 250/288 |
| 2013/0187044 | A1 * | 7/2013 | Ding | H01J 49/065 250/292 |
| 2013/0306858 | A1 * | 11/2013 | Giles | G01N 27/622 250/283 |
| 2014/0061457 | A1 * | 3/2014 | Berdnikov | H01J 49/065 250/281 |
| 2015/0076343 | A1 * | 3/2015 | Tolmachev | G01N 27/622 250/290 |
| 2015/0348769 | A1 * | 12/2015 | Park | H01J 49/063 250/288 |
| 2015/0364309 | A1 * | 12/2015 | Welkie | H01J 49/40 250/282 |
| 2016/0071715 | A1 * | 3/2016 | Anderson | H01J 49/062 315/111.81 |
| 2016/0225598 | A1 * | 8/2016 | Ristroph | H01J 49/062 |
| 2016/0322209 | A1 | 11/2016 | Wouters et al. | |
| 2017/0069477 | A1 * | 3/2017 | Green | H01J 49/0031 |
| 2017/0076931 | A1 * | 3/2017 | Ibrahim | H01J 49/26 |
| 2017/0200595 | A1 * | 7/2017 | Giles | G01N 27/622 |
| 2017/0236698 | A1 * | 8/2017 | Zhang | H01J 49/062 250/296 |

FOREIGN PATENT DOCUMENTS

| | | |
|---|---|---|
| EP | 3038134 | 6/2016 |
| EP | 3252460 | 12/2017 |
| GB | 2499587 | 8/2013 |
| WO | WO 2016/034125 | 3/2016 |
| WO | WO 2018/048494 | 3/2018 |

OTHER PUBLICATIONS

International Search Report and Written Opinion for related International Application No. PCT/US2018/065380, dated Mar. 29, 2019, 12 pages.

Garimella et al., "Simulation of Electric Potentials and Ion Motion in Planar Electrode Structures for Lossless Ion Manipulations (SLIM)," *J. Am. Soc. Mass Spectrom.* 25(11):1890-1896 (Nov. 2014).

Giles et al., "A method for direct measurement of ion mobilities using a travelling wave ion guide," *International Journal of Mass Spectrometry*, 298(1):10-16 (Dec. 2010).

Giles et al., "Applications of a travelling wave-based radio-frequency-only stacked ring ion guide," *Rapid Commun. Mass Spectrom.*, 18(20):2401-2414 (Oct. 30, 2004).

Giles et al., "Enhancements in travelling wave ion mobility resolution," *Rapid Commun. Mass Spectrom.*, 25(11):1559-1566 (Jun. 15, 2011).

Glaskin et al., "Ion Trapping for Ion Mobility Spectrometry Measurements in a Cyclical Drift Tube," *Anal. Chem.*, 85(15):7003-7008 (Jul. 2013).

Hamid et al., "Characterization of Traveling Wave Ion Mobility Separations in Structures for Lossless Ion Manipulations," *Anal. Chem.*, 87:11301-11308 (Oct. 28, 2015).

Ibrahim et al., "Development of a new ion mobility (quadrupole) time-of-flight mass spectrometer," *International Journal of Mass Spectrometry*, 377:655-662 (Feb. 1, 2015).

International Search Report/Written Opinion for International Application No. PCT/US14/11291, International Filing Date Jan. 13, 2014, dated Jun. 6, 2014.

International Search Report and Written Opinion for related International Application No. PCT/US2017/039770, dated Dec. 15, 2017.

Merenbloom et al., "Effects of Select Anions from the Hofmeister Series on the Gas-Phase Conformations of Protein Ions Measured with Traveling-Wave Ion Mobility Spectrometry/Mass Spectrometry," *J. Am. Soc. Mass Spectrom.* 22:1978-1990 (Nov. 22, 2011).

PCT Recordation of Search History for International Application No. PCT/US14/11291, International Filing Date Jan. 13, 2014, Date during which the search was conducted May 15, 2014, Date of Completion of Recordation of Search History Form May 22, 2014.

Pringle et al., "An investigation of the mobility separation of some peptide and protein ions using a new hybrid quadrupole/travelling wave IMS/oa-ToF instrument," *International Journal of Mass Spectrometry*, 261(1):1-12 (Mar. 1, 2007).

Shvartsburg et al., "Fundamentals of Traveling Wave Ion Mobility Spectrometry," *Anal. Chem.*, 80(24):9689-9699 (Dec. 15, 2008).

Smith et al., "Deciphering drift time measurements from travelling wave ion mobility spectrometry-mass spectrometry studies," *European Journal of Mass Spectrometry*, 15(2):113-130 (Jan. 2009).

Sobott et al., "A Tandem Mass Spectrometer for Improved Transmission and Analysis of Large Macromolecular Assemblies," *Anal. Chem.*, 74(6):1402-1407 (Apr. 2002).

Tolmachev et al., "Characterization of Ion Dynamics in Structures for Lossless Ion Manipulations," *Anal. Chem.*, 86(18):9162-9168 (Sep. 16, 2014).

Webb et al., "Experimental Evaluation and Optimization of Structures for Lossless Ion Manipulations for Ion Mobility Spectrometry with Time-of-Flight Mass Spectometry," *Anal. Chem.*, 86(18):9169-9176 (Sep. 5, 2014).

Webb et al., "Mobility-Resolved Ion Selection in Uniform Drift Field Ion Mobility Spectrometry/Mass Spectrometry: Dynamic Switching in Structures for Lossless Ion Manipulations," *Anal. Chem.*, 86(19):9632-9637 (Oct. 7, 2014).

Zhang et al., "Ion Trapping, Storage, and Ejection in Structures for Lossless Ion Manipulations," *Anal. Chem.*, 87(12):6010-6016 (May 2015).

Zhong et al., "Characterizing the resolution and accuracy of a second-generation traveling-wave ion mobility separator for biomolecular ions," *The Royal Society of Chemistry*, 136(17):3534-3541 (Mar. 2011).

(56) References Cited

OTHER PUBLICATIONS

International Search Report and Written Opinion for related International Application No. PCT/US2019/039302, dated Sep. 20, 2019, 11 pages.

* cited by examiner

DEVICE TO MANIPULATE IONS OF SAME OR DIFFERENT POLARITIES

CROSS REFERENCE TO RELATED APPLICATION

This application is a continuation of U.S. patent application Ser. No. 15/260,046, filed Sep. 8, 2016, which is incorporated by reference herein in its entirety.

ACKNOWLEDGEMENT OF GOVERNMENT SUPPORT

This invention was made with government support under grant DE-AC05-76RL01830 awarded by the United States Department of Energy and GM103493 awarded by the National Institutes of Health. The government has certain rights in the invention.

FIELD

The field pertains to ion manipulation devices.

BACKGROUND

Ion manipulation technology has allowed the discovery of new applications related to material detection and analysis and composition formation, and has fostered the creation of increasingly useful tools and instruments related to, for example, mass spectrometry. However, problems associated with manipulating ions of the same or different polarities have remained.

SUMMARY

According to one aspect of the disclosed technology, an apparatus includes a first pair of opposing electrode arrangements situated to confine ions between the first pair opposing electrode arrangements in a confinement volume portion of a confinement volume inwardly laterally in a first confinement direction with respect to a longitudinal ion propagation direction, each opposing electrode arrangement of the first pair including an arrangement of RF electrodes situated to receive an unbiased RF voltage having an alternate phase between adjacent RF electrodes of the arrangement of RF electrodes of the opposing electrode arrangement of the first pair so as to provide the confining of ions between the first pair of opposing electrode arrangements, and a second pair of opposing electrode arrangements separate from the first pair of opposing electrode arrangements and situated to confine the ions between the second pair of opposing electrode arrangements in the confinement volume inwardly laterally in a second confinement direction that complements the first confinement direction, each opposing electrode arrangement of the second pair including an arrangement of RF electrodes situated to receive an unbiased RF voltage having an alternate phase between adjacent RF electrodes of the arrangement of RF electrodes of the opposing electrode arrangement of the second pair.

In some representative embodiments of the disclosed technology, RF electrodes of each arrangement of RF electrodes of the second pair of opposing electrode arrangements are stacked laterally with respect to the second confinement direction and wherein the RF electrodes of the second pair of opposing electrode arrangements extend longitudinally along the confinement volume and provide confinement of the ions in the second confinement direction. In additional representative embodiments of the disclosed technology, each opposing electrode arrangement of the second pair includes a traveling wave electrode arrangement situated to confine the ions in the confinement volume in the second confinement direction.

According to another aspect of the disclosed technology, a method includes receiving ions in a confinement volume for movement along a longitudinal ion propagation direction, and with a first opposing arrangement of electrodes providing an unbiased RF field, confining the ions in the confinement volume in a first lateral inward direction between the first opposing arrangement of electrodes, and with a second opposing arrangement of electrodes that includes RF electrodes situated to provide an unbiased RF field, confining the ions in the confinement volume in a second lateral inward direction that complements the first inward direction.

In some representative method embodiments of the disclosed technology, the confining of the ions in the second inward direction includes providing an unbiased RF voltage to a pair of opposing arrangements of RF electrodes of the second opposing arrangement of electrodes so as to provide the unbiased RF field, each opposing arrangement forming a stack with adjacent RF electrodes of the stack having an alternate phase, each RF electrode extending longitudinally along the confinement volume so as to provide the confining of the ions in the second inward direction. In further representative method embodiments of the disclosed technology, the confining of the ions in the second inward direction includes providing an unbiased RF voltage to RF electrodes of a pair of opposing arrangements of electrodes of the second opposing arrangement of electrodes so as to provide the unbiased RF field and ion confinement in the first inward direction in an extended confinement region of the confinement volume and includes providing a variable DC voltage to traveling wave electrodes of the pair of opposing arrangements of electrodes that are alternately arranged between the RF electrodes of the pair of opposing arrangements of electrodes so as to produce a corresponding traveling wave to confine the ions in the extended confinement region in the second inward direction.

According to a further aspect of the disclosed technology, an apparatus includes a first pair of opposing electrode arrangements situated to confine ions between the first pair opposing electrode arrangements in a confinement volume portion of a confinement volume inwardly in a first confinement direction that is perpendicular to an ion propagation direction, each opposing electrode arrangement of the first pair including an arrangement of RF electrodes situated to receive an unbiased RF voltage having an alternate phase between adjacent RF electrodes of the arrangement of RF electrodes of the opposing electrode arrangement of the first pair so as to provide the confining of ions between first pair of opposing electrode arrangements, a second pair of opposing electrode arrangements separate from the first pair of opposing electrode arrangements and situated to confine the ions between the second pair of opposing electrode arrangements in the confinement volume inwardly in a second confinement direction that is mutually perpendicular to the first confinement direction and the ion propagation direction, each opposing electrode arrangement of the second pair including an arrangement of RF electrodes situated to receive an unbiased RF voltage having an alternate phase between adjacent RF electrodes of the arrangement of RF electrodes of the opposing electrode arrangement of the second pair, and a traveling wave electrode arrangement situated between adjacent RF electrodes of the first pair of opposing electrode arrangements and that includes a plurality of traveling wave electrodes extending in a sequence parallel to the ion propagation direction so as to receive a variable DC voltage and to produce a corresponding traveling wave to move the ions along the ion propagation direction, wherein the first and second pairs of opposing electrode arrangements are situated so as to confine ions of opposite polarities.

The foregoing and other objects, features, and advantages of the disclosed technology will become more apparent from the following detailed description, which proceeds with reference to the accompanying figures.

DETAILED DESCRIPTION

Figure 1A:
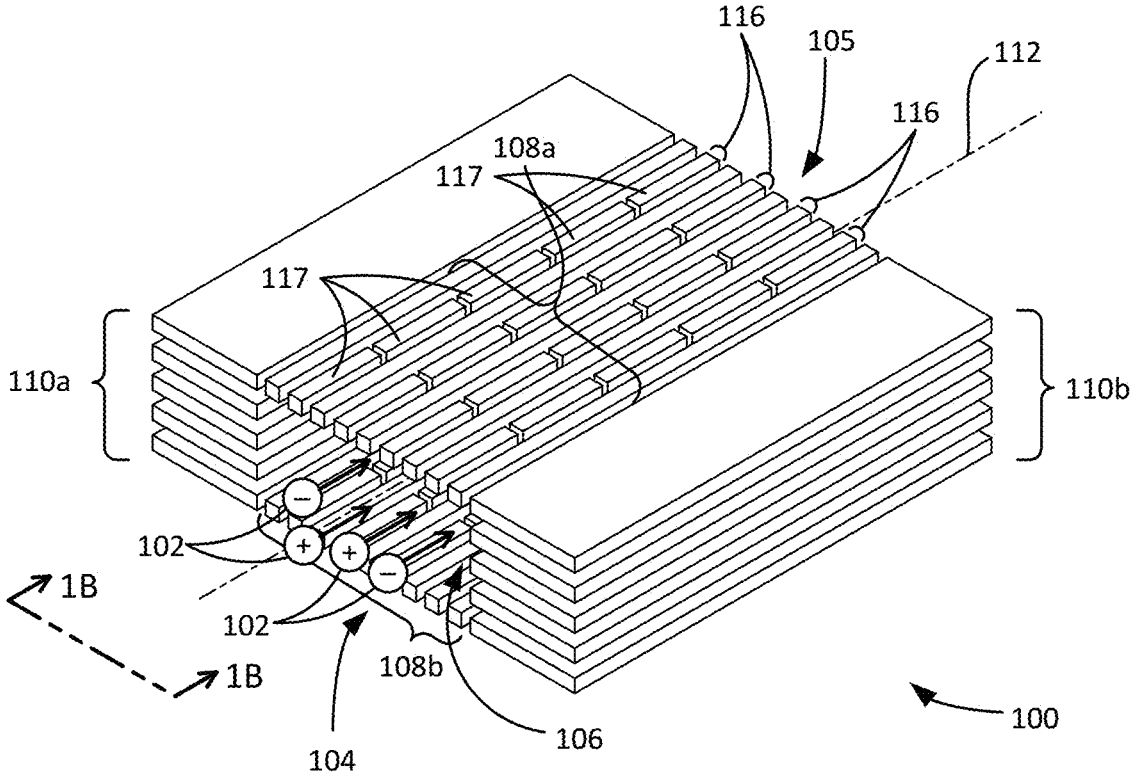
FIG. 1A is an isometric perspective view of an example ion manipulation apparatus.

As used in this application and in the claims, the singular forms "a," "an," and "the" include the plural forms unless the context clearly dictates otherwise. Additionally, the term "includes" means "comprises." Further, the term "coupled" does not exclude the presence of intermediate elements between the coupled items.

The systems, apparatus, and methods described herein should not be construed as limiting in any way. Instead, the present disclosure is directed toward all novel and non-obvious features and aspects of the various disclosed embodiments, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present or problems be solved. Any theories of operation are to facilitate explanation, but the disclosed systems, methods, and apparatus are not limited to such theories of operation.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed systems, methods, and apparatus can be used in conjunction with other systems, methods, and apparatus. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art. In some examples, values, procedures, or apparatus' are referred to as "lowest", "best", "minimum," or the like. It will be appreciated that such descriptions are intended to indicate that a selection among many used functional alternatives can be made, and such selections need not be better, smaller, or otherwise preferable to other selections.

Some examples are described in relation to one more longitudinal and lateral directions generalized to correspond to ion movement or confinement. Directions typically apply to ion movement, trapping, and confinement and are provided by electric fields produced by one or more electrodes that are arranged to define one or more volumes of various shapes, sizes, and configurations. A direction can correspond to a single path, multiple paths, bi-directional movement, inward movement, outward movement, or a range of movements. Actual ion movement paths vary and can depend on the various characteristics of the electrode arrangements and electric fields produced by the corresponding electrodes and the positional, polarity, kinetic, or other characteristics of the ions received in a confinement volume. Directions referred to herein are generalized and actual specific particle movements typically correspond to electric fields produced and the electrical mobilities of the ions propagating in relation to the electric fields.

The disclosed technology is directed to devices, apparatus, and methods of manipulating ions, including the use of electric fields to create field-defined pathways, traps, conduits, and switches to manipulate ions with minimal or no losses. In some embodiments, complex sequences of ion separations, transfers, path switching, and trapping can occur in the volume provided between electrode arrays situated on one or more surfaces positioned apart from each other. In some examples, ion confining fields are provided by unbiased radio frequency (RF) electric fields. In additional examples, ion confining fields provided by unbiased RF fields and traveling wave electric fields. In representative examples, ions of opposite polarity are moved, trapped, or manipulated using RF electric fields or RF and traveling wave electric fields. RF electric fields are typically applied so that RF fields generated by adjacent RF electrodes are out of phase, typically by approximately 180°, to form an alternating RF field arrangement that inhibits the ions from approaching the electrodes and that provides confinement. Confinement can be provided over a range of pressures (e.g., less than approximately 0.001 torr to approximately 1000 torr), and over a useful, broad, and adjustable mass to charge (m/z) range associated with the ions. In some examples ions are manipulated for analysis through mass spectrometry or with a mass spectrometer, and where pressures of less than approximately 0.1 torr to approximately 50 torr can be used to readily manipulate ions over a useful m/z range, e.g., m/z 20 to greater than approximately 5,000. In some examples, ion confinement volumes includes gases or reactants. Arrangements of RF electrodes and traveling wave electrodes receive corresponding potentials that allow creation of ion traps and/or conduits in the volume or gap between the electrode arrangements so that lossless or substantially lossless storage and/or movement of ions of the same or different polarities can be achieved, including without the application of static or superimposed DC potentials. For example, lossless manipulation can include losses of less than 0.1%, 1%, or 5% of ions injected into a corresponding ion confinement volume.

Traveling waves are typically created by dynamically applying DC potentials to a plurality of electrodes arranged in one or more sequences. Traveling wave electrode sets can be formed by one or more sequences of traveling wave electrodes situated in series. As the DC potentials are varied between adjacent electrodes of a traveling wave electrode sequence, a traveling wave can be formed with a speed based on the time dependent variation of the DC potentials. Varying traveling wave characteristics can affect and manipulate various movements of ions having different ion mobilities, including producing ion confinement, lossless transport, and ion separation. In some examples, in conjunction with traveling waves, ions can be losslessly confined in an ion confinement volume for extended durations, such as multiple hours. One such characteristic is the traveling wave speed, with ions that have higher mobility moving or surfing with the traveling wave and ions that have lower mobility rolling over and lagging behind the traveling wave to allow ion separation. Another such characteristic is traveling wave amplitude, which can transport ions with lower ion mobilities with a corresponding increase in traveling wave amplitude. Traveling wave amplitudes are typically selected based on ion mobility characteristics and the desired ion manipulation to be in the range of greater than 0 V up to 30 V, 50 V, 80 V, 100 V, or greater. Traveling wave speeds are typically selected based on ion mobility characteristics and the desired ion manipulation to be in the range of less than 5 m/s, 20 m/s 50 m/s, 100 m/s, 200 m/s, or 500 m/s. Traveling wave frequencies are typically selected between 10 kHz and 200 kHz.

Figure 1B:
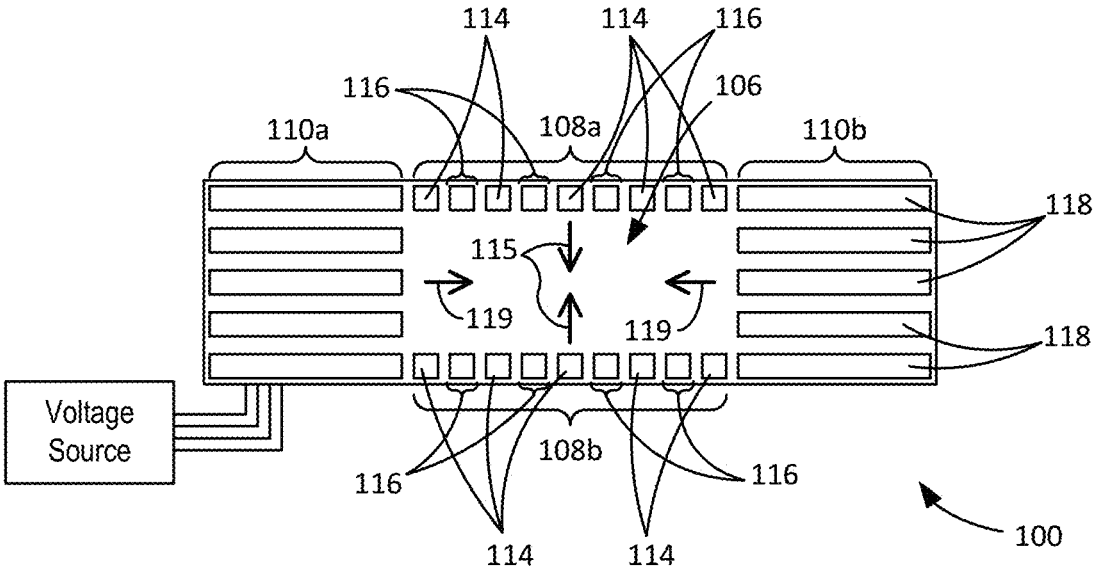
FIG. 1B is an end view of the ion manipulation apparatus of FIG. 1A.

FIGS. 1A-1B show an example of an ion manipulation apparatus 100 situated to receive ions 102 through an entrance aperture 104 in an ion confinement volume 106 and to propagate, separate, trap, and/or move the ions 102, including transporting the ions 102 from the entrance aperture 104 to an exit aperture 105. The ion confinement volume 106 is generally defined between a first pair of opposing electrode arrangements 108*a*, 108*b* and a second pair of opposing electrode arrangements 110*a*, 110*b*. An ion propagation axis 112 extends along the ion confinement volume 106 and indicates a general longitudinal propagation direction for the ions 102. In some examples, the ions 102 have opposite polarities and are moved through the ion confinement volume 106 from the entrance aperture 104 to the exit aperture 105. In representative examples, the opposing electrode arrangements 108*a*, 108*b* have a mirrored configuration and the opposing electrode arrangements 110*a*, 110*b* have a mirrored configuration, forming a symmetric confinement area perpendicular to the ion propagation axis through the ion confinement volume. In further examples, electrode arrangements or portions of electrode arrangements are not identical or are not mirrored.

In representative examples, each of the opposing electrode arrangements 108*a*, 108*b* includes an arrangement of electrodes 114 that extend along the length of the ion confinement volume 106 and that are situated to receive one or more RF voltages, typically in the frequency range of 100 kHz to 100 MHz, which are not biased with a DC voltage, so as to provide confinement of ions with the same or different polarities. The electrodes 114 are arranged so as to receive RF voltages alternately so that the RF voltages received by adjacent electrodes of the electrodes 114 are approximately 180° out of phase from each other. With the applied RF voltages, the electrodes 114 move and confine the ions 102 in the ion confinement volume 106 laterally in an inward direction 115 between the opposing electrode arrangements 108*a*, 108*b*, which is generally perpendicular or normal to the ion propagation axis 112 or longitudinal path through the ion confinement volume 106 in the parallel configuration of opposed electrode arrangements 108 shown. The RF voltages received by the electrodes 114 can vary, e.g., with respect to frequency and amplitude, over time or between adjacent electrodes 114.

Each of the opposing electrode arrangements 108*a*, 108*b* also includes one or more traveling wave electrode arrangements 116 situated between adjacent electrodes 114. In some examples, traveling wave electrode arrangements 116 are alternately situated between adjacent electrodes 114. In further examples, two or more traveling wave electrode arrangements 116 are situated between adjacent electrodes 114, and in additional examples, two or more electrodes 114 are situated between adjacent traveling wave electrode arrangements 116. The traveling wave electrode arrangements 116 can each include a sequence of electrodes 117 such as a plurality of electrode segments extending along the length or a portion of the length of the ion confinement volume 106 and that are situated to receive separate time-varying DC voltages. The DC voltages vary with time so as to produce a traveling wave along the selected traveling wave electrode arrangement 116. The traveling wave produces a movement, net movement, separation, or trapping of the ions 102 in the ion confinement volume 106 associated with the direction of the traveling wave, such as in the direction of the ion propagation axis 112 or longitudinal extent of the ion confinement volume 106. In some examples, traveling wave characteristics such as wave speed or amplitude are varied between different traveling wave electrode arrangements 116.

In representative examples, each of the opposing electrode arrangements 110*a*, 110*b* includes a plurality of electrodes 118 each extending parallel to each other along the length of the ion confinement volume 106 and spaced apart from each other in a direction parallel to the inward direction 115 so as to form an electrode stack. Each plurality of electrodes 118 is situated to receive RF voltages, such as in the range of 100 kHz to 100 MHz, which are not biased with a DC voltage, so as to provide confinement of ions with the same or different polarities. Each plurality of electrodes 118 receives RF voltages alternately so that the RF voltages received by adjacent electrodes of the plurality of electrodes 118 are approximately 180° out of phase with each other. The RF voltages received by the electrodes 118 need not be identical, and in many examples are not identical, to those received by the electrodes 114 and can also vary, e.g., with respect to frequency and amplitude, over time or between adjacent electrodes 118. With the applied RF voltages, the electrodes 118 move and confine the ions 102 in the ion confinement volume 106 laterally in an inward direction 119 that complements or supports the inward direction 115. In representative examples, the inward direction 119 is generally perpendicular to the ion propagation axis 112 and the inward direction 115. The electrodes 118 can have a width that extends laterally (e.g., parallel to the inward direction 119) so that the electrodes 118 are substantially planar. In some embodiments, the ion propagation axis 112 is curved or bent. In further examples, the lateral inward directions 115, 119 are not perpendicular to each other or to the ion propagation axis 112. RF fields generated with the electrodes 118 have sufficient field penetration so as to provide suitable ion confinement.

Figure 2A:
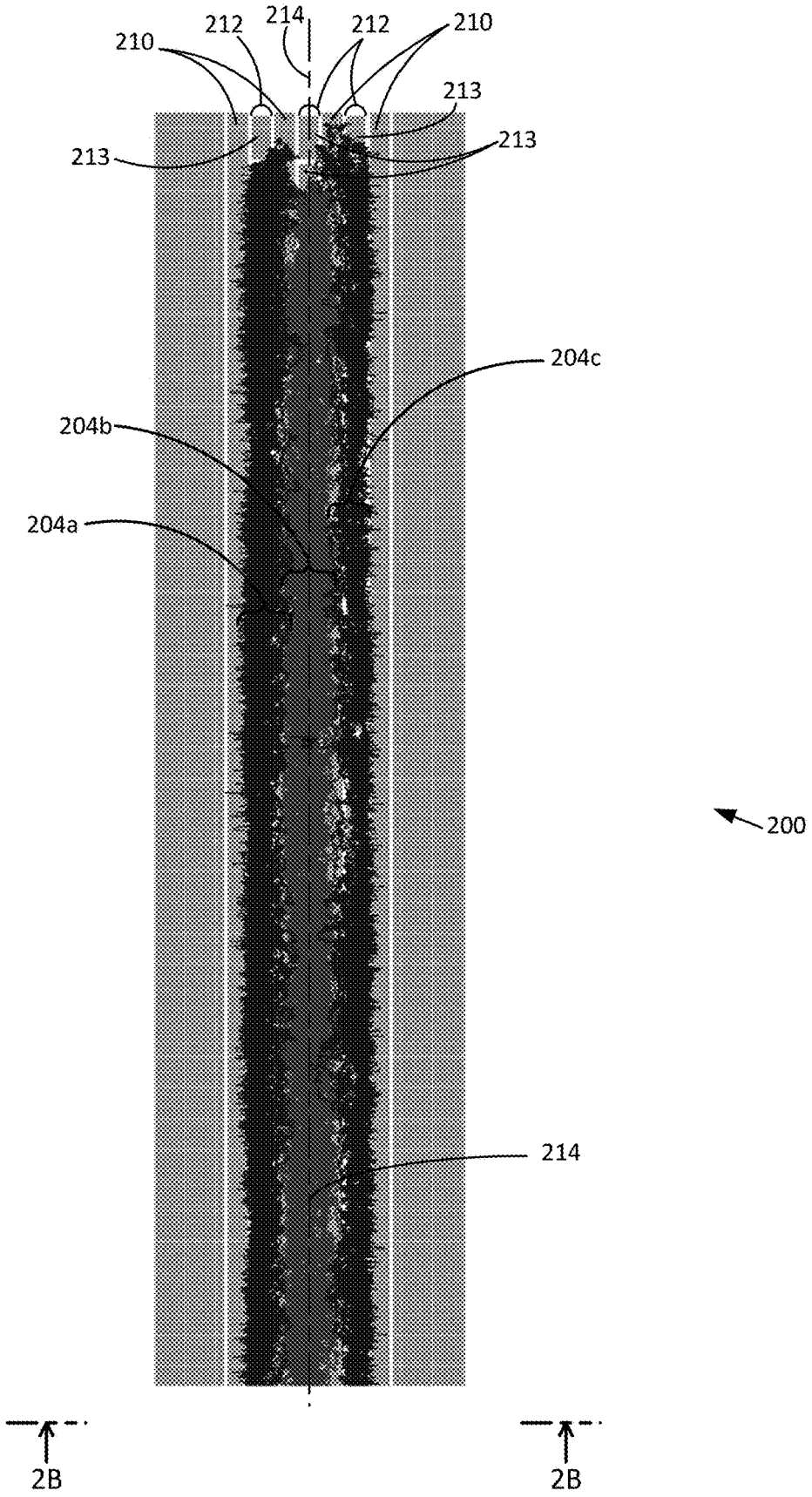
FIG. 2A is a top view of an example ion manipulation apparatus manipulating ions of different polarities.
Figure 2B:
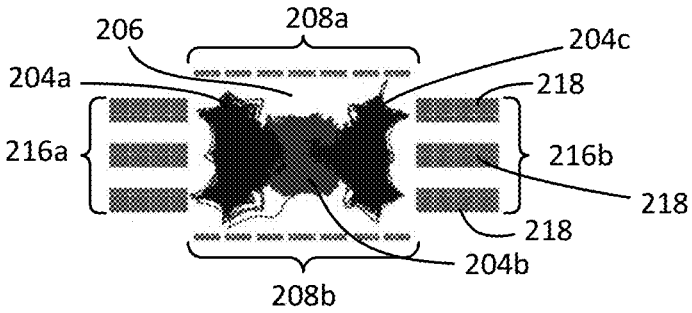
FIG. 2B is an end view of the ion manipulation apparatus example of FIG. 2A.

FIGS. 2A-2B depicts a representative example of an ion manipulation apparatus 200 manipulating ions 202 into three ion sets 204*a*-204*c* that are confined within a confinement volume 206. The confinement volume 206 is defined between a first pair of opposing electrode arrangements 208*a*, 208*b* that includes RF electrodes 210 that provide RF electric fields extending into the confinement volume 206 which are phase shifted between adjacent RF electrodes 210 (e.g., by 180°). The first pair of opposing electrode arrangements 208*a*, 208*b* also includes a plurality of traveling wave electrode sets 212 that includes traveling wave electrodes 213 that are situated to move, separate, or trap the ions 202 along an ion propagation direction 214, which is generally towards the top or bottom, or both, of FIG. 2A. For example, the ions 202 can be inserted into the ion confinement volume through an open end and become segregated or spread laterally and/or longitudinally into a plurality of ion groups within the confinement volume 206.

The confinement volume 206 is further defined between a second pair of opposing electrode arrangements 216*a*, 216*b*. The opposing electrode arrangements 216*a*, 216*b* form respective electrode stacks having a plurality of RF electrodes 218 spaced apart from each other in a first direction that extends vertically as depicted in FIG. 2B and that is generally perpendicular to the ion propagation direction 214. The RF electrodes 218 generate electric fields that extend into the confinement volume 206 and that are also phase-shifted between adjacent RF electrodes 218 so as to support or provide a lateral confinement of ions in the confinement volume 206 at least in a second direction away from the RF electrodes 218 and into the confinement volume 206. The confinement provided by the RF electrodes 218 generally complements a lateral confinement provided by the RF electrodes 210, so as to support inhibiting the escape of the ions 202 from the confinement volume 206 or the contact of the ions 202 with the RF electrodes 218 and corresponding surfaces. In representative examples, the second direction is generally perpendicular to the first direction in which the RF electrodes 218 of the stacks are spaced apart and perpendicular to the ion propagation direction 214.

An asymmetric traveling wave voltage between 0 V and 20 V is applied to the traveling wave electrode sets 212 that corresponds to an amplitude of the traveling wave. A traveling wave speed of 100 m/s is produced by varying the traveling wave voltage between adjacent traveling wave electrodes 213 in the traveling wave electrode sets 212. The duration of the traveling wave can vary so that one or more adjacent traveling wave electrodes 213 can have the same or different voltage. The ion sets 204*a*-204*c* each have an m/z of 622 though the ions 202 of the ion sets 204*a*, 204*c* have a positive polarity and the ions 202 of the ion set 204*b* have a negative polarity. An RF voltage of 150 V is applied to the RF electrodes 210, 218 so as to confine the ions 202 of the ion sets 204*a*-204*c* within the confinement volume 206. The negatively charged ions 204*b* are generally confined to a center region of the confinement volume 206 and the positively charged ions 204*a*, 204*c* are generally confined to side regions adjacent to the center region. In some examples, the side regions can overlap the center region so that ions of different polarities can become separated and remain overlapping within the confinement volume 206 and in other examples the side regions can be separate from center region so that ions of different polarities are separated and non-overlapping within the confinement volume 206.

Figure 3A:
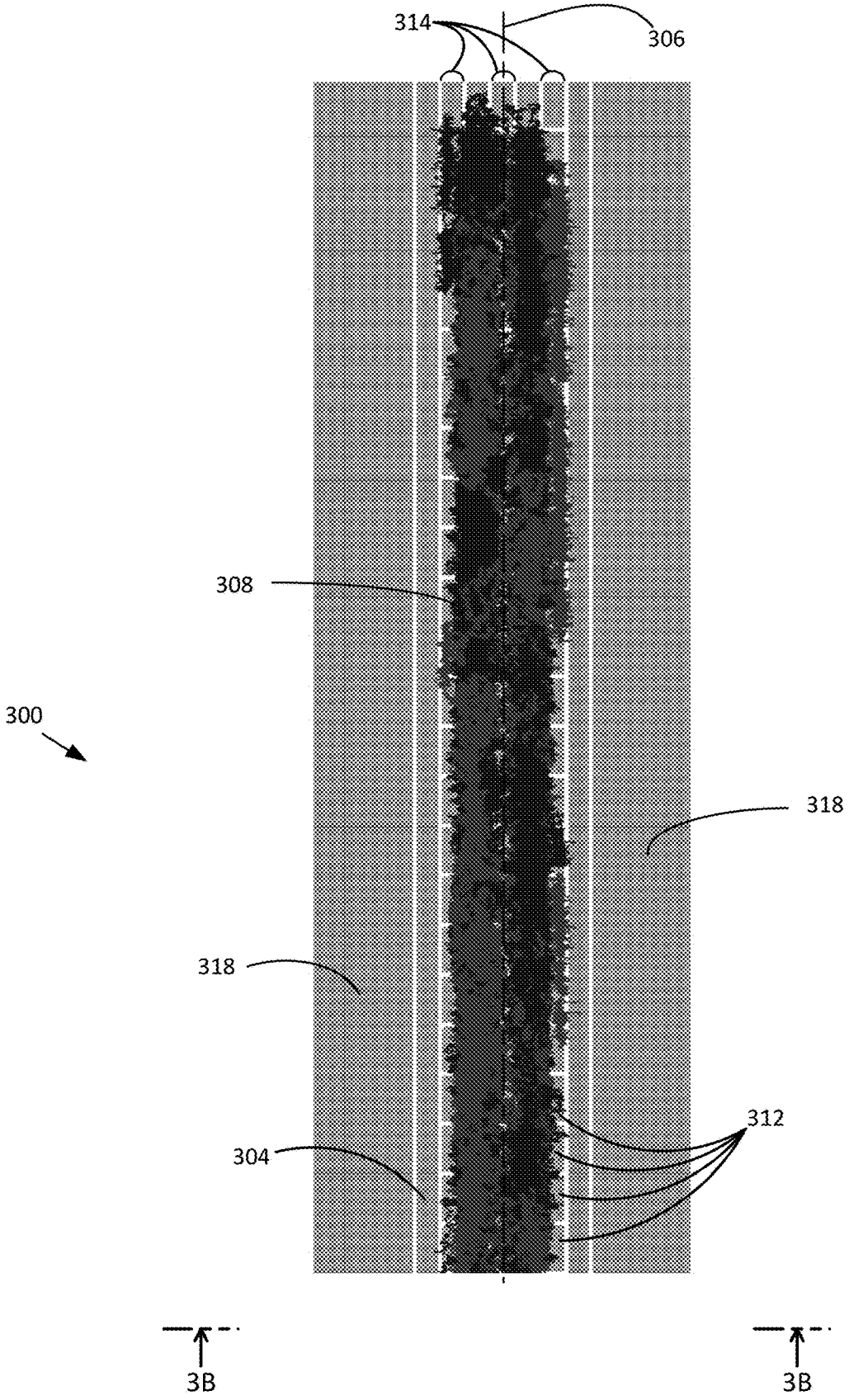
FIG. 3A is a top cross-sectional view of another example ion manipulation apparatus manipulating ions of different polarities.
Figure 3B:
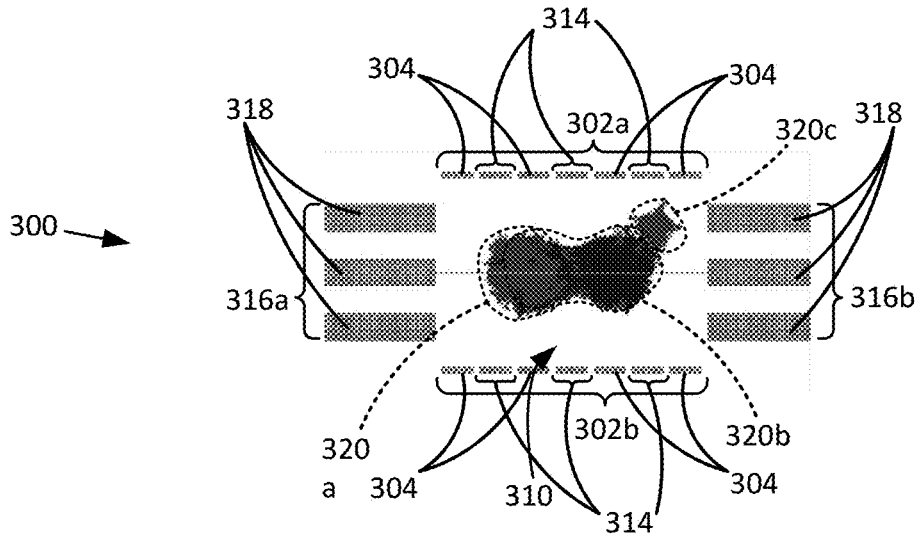
FIG. 3B is an end view of the ion manipulation apparatus example of FIG. 3A.

FIGS. 3A and 3B shows an ion manipulation apparatus 300 having a substantially similar electrode arrangement as the ion manipulation apparatus 200. A pair of opposite electrode arrangements 302*a*, 302*b* include RF electrodes 304 extending along a propagation direction 306 for the confinement of ions 308 propagating in a confinement volume 310 of the ion manipulation apparatus 300, and further include traveling wave electrodes 312 forming traveling wave electrode sets 314 that also extend along the propagation direction 306. Another pair of opposite electrode arrangements 316*a*, 316*b* includes RF electrodes 318 that also extend along the propagation direction 306. The RF electrodes 304, 318 provide RF electric fields that extend into the confinement volume 310 so as to laterally confine the ions 308 within the confinement volume 310 and provide lossless manipulation of the ions 308. The propagation direction 306 is shown to correspond with an axis centrally situated in the confinement volume 310 though it will be appreciated that ions 308 are not confined to the axis itself. As shown, the ions 308 have an m/z equal to 622 and include three separate ion sets 320*a*-320*c* with the ion sets 320*a*, 320*c* having a negative polarity and the ion set 320*b* having a positive polarity. A symmetric traveling wave voltage varying between −10 V and 10 V is applied to the traveling wave electrodes 312 of the traveling wave electrode sets 314 to move the ions 308 in the confinement volume 310. The negatively charged ion set 320*a* and the positively charged ion set 320*b* are generally confined to symmetrically situated adjacent side regions and the ions 308 of the negatively charged ion set 320*c* propagate in a side region opposite the ion set 320*a*. Varying a traveling wave voltage from symmetrical to non-symmetrical (for example) can produce different separations between ions of opposite polarities propagating within a common confinement volume.

Figure 4:
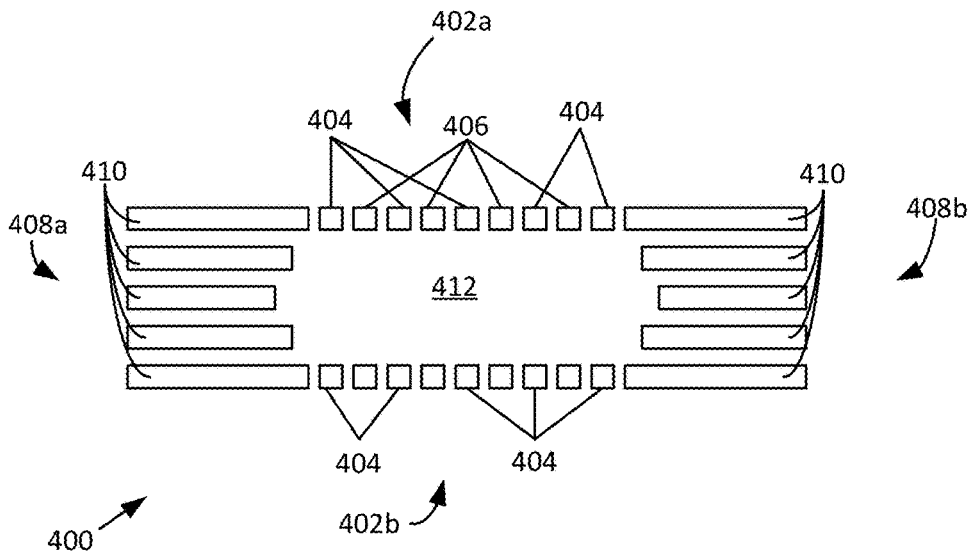
FIG. 4 is an example of another ion manipulation apparatus having a non-rectangular cross-section.

In FIG. 4, an end view of an example of an ion manipulation apparatus 400 is shown. The ion manipulation apparatus 400 includes an opposing pair of electrode arrangements 402*a*, 402*b* each including a plurality of RF electrodes 404 and a plurality of traveling wave electrodes arrangements 406 interposed between adjacent RF electrodes of the plurality of RF electrodes 404. The ion manipulation apparatus 400 also includes another opposing pair of electrode arrangements 408*a*, 408*b* situated adjacent to the pair of electrode arrangements 402 and each including a plurality of adjacently situated and spaced apart RF electrodes 410. The opposing pairs of electrode arrangements 402, 408 are situated so as to define an ion confinement area 412. An ion confinement volume is formed as the electrodes 404, 410 also generally extend into the plane of FIG. 4. The ion confinement area 412 can have various shapes, including rectangular and non-rectangular shapes, between different examples of the ion manipulation apparatus 400 or within the same apparatus 400. For example, different RF electrodes 410 can extend into the confinement area by different amounts. In some examples, the extent of the RF electrodes 410 into the ion confinement area 412 varies along the length so that a tapered, expanding, curved, merging, or other shape is formed for the ion confinement volume.

Figure 5:
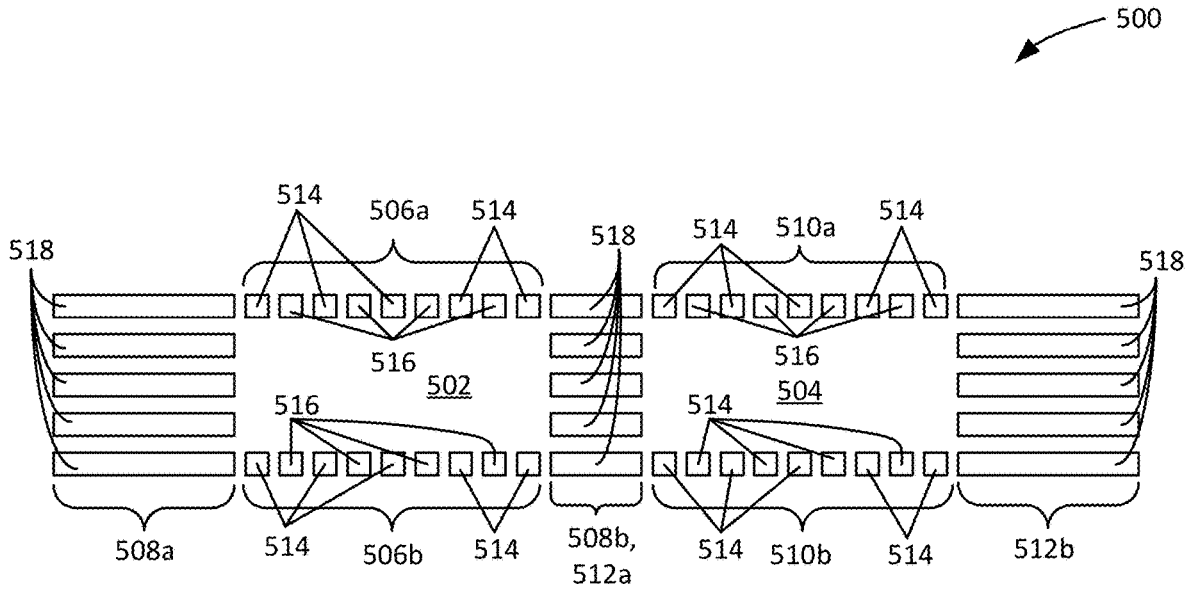
FIG. 5 is an example of another ion manipulation apparatus having multiple ion conduits.

FIG. 5 shows an end view of an example ion manipulation apparatus 500 that includes two ion confinement areas 502, 504 defining separate ion conduits. A first pair of opposing electrode arrangements 506*a*, 506*b* and a second pair of opposing electrode arrangements 508*a*, 508*b* surround and define the ion confinement area 502. A third pair of opposing electrode arrangements 510*a*, 510*b* and a fourth pair of opposing electrode arrangements 512*a*, 512*b* surround and define the ion confinement area 504. In representative examples, a portion or all of electrodes of the electrode arrangements 508*b*, 512*a* are the same so that the ion confinement areas 502, 504 share a common electrode border. The electrodes of the pairs of opposing electrode arrangements 506, 510 include RF electrodes 514 extending into the plane of FIG. 5 along the direction of propagation of confined ions. Adjacent RF electrodes 514 typically have an out-of-phase relationship, for example, by approximately 180°. Traveling wave electrodes 516 are situated between adjacent RF electrodes 514 and provide movement and confinement of the ions propagating in the ion conduits. The electrodes of the pairs of opposing electrode arrangements 508, 512 include RF electrodes 518 which also typically have an out-of-phase relationship between adjacent RF electrodes 518. In some examples, adjacent ion conduits can be arranged so that other sides of ion confinement areas share a common electrode border. For example, the electrodes of the electrode arrangements 506*a*, 510*b* can be the same so as to form a common border and position the ion confinement area 504 adjacent the ion confinement area 502 in the plane of FIG. 5.

Figure 6A:
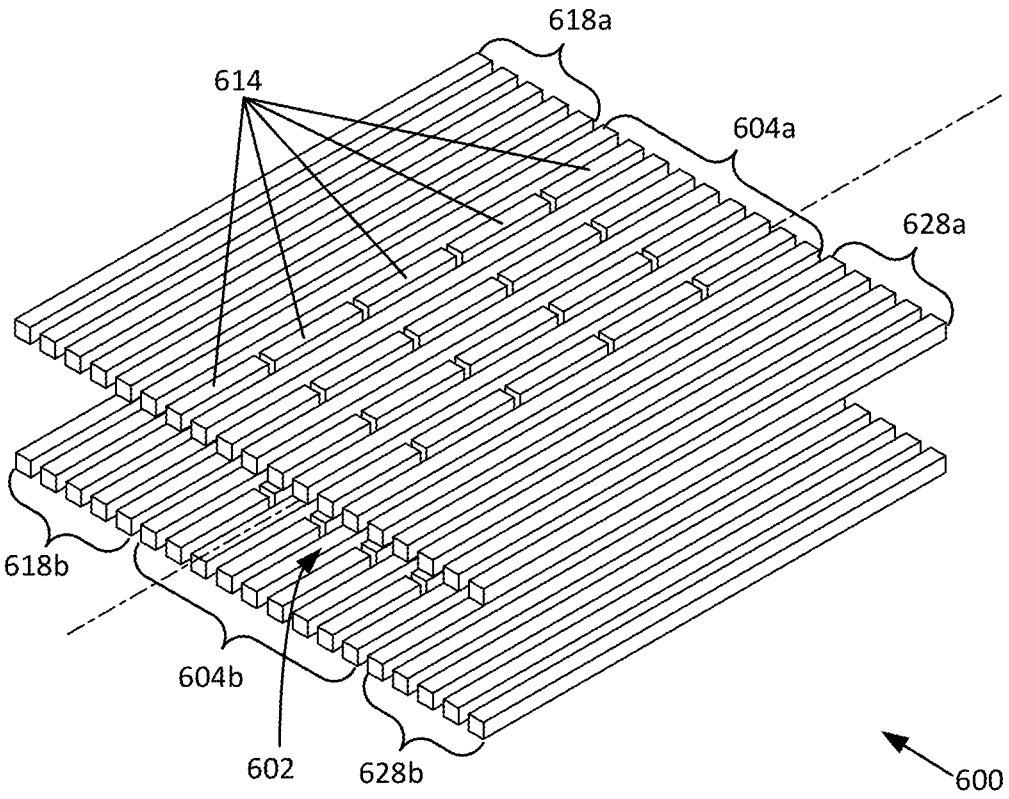
FIG. 6A is an isometric perspective view of another example ion manipulation apparatus.
Figure 6B:
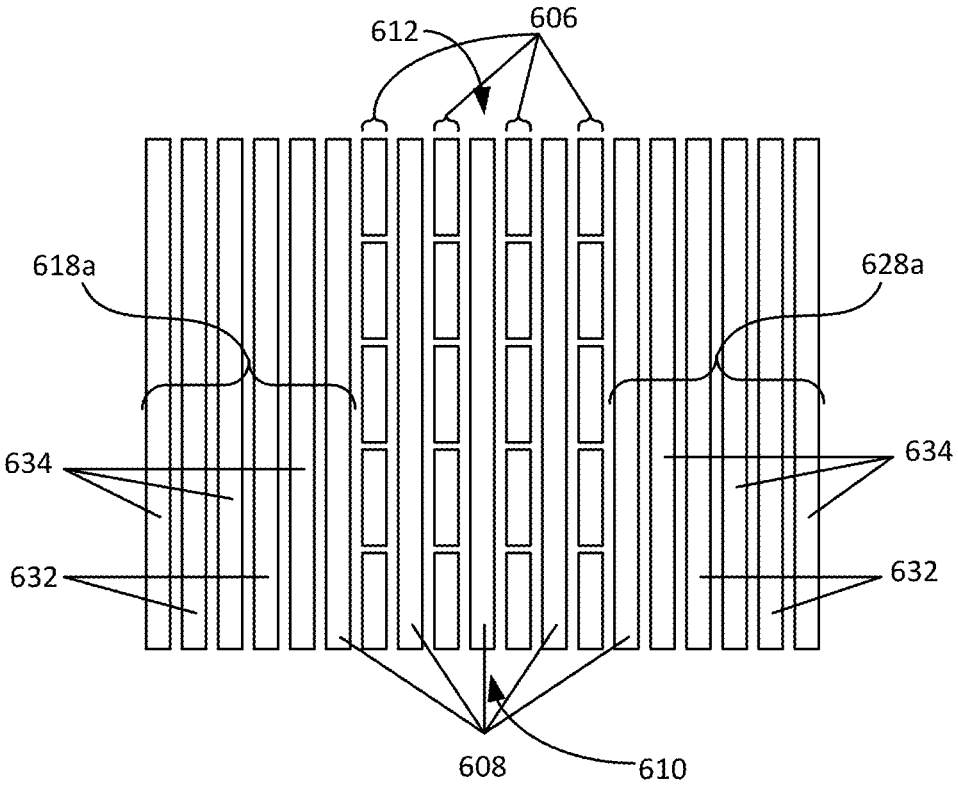
FIG. 6B is a top view of the ion manipulation apparatus example of FIG. 6A.
Figure 6C:
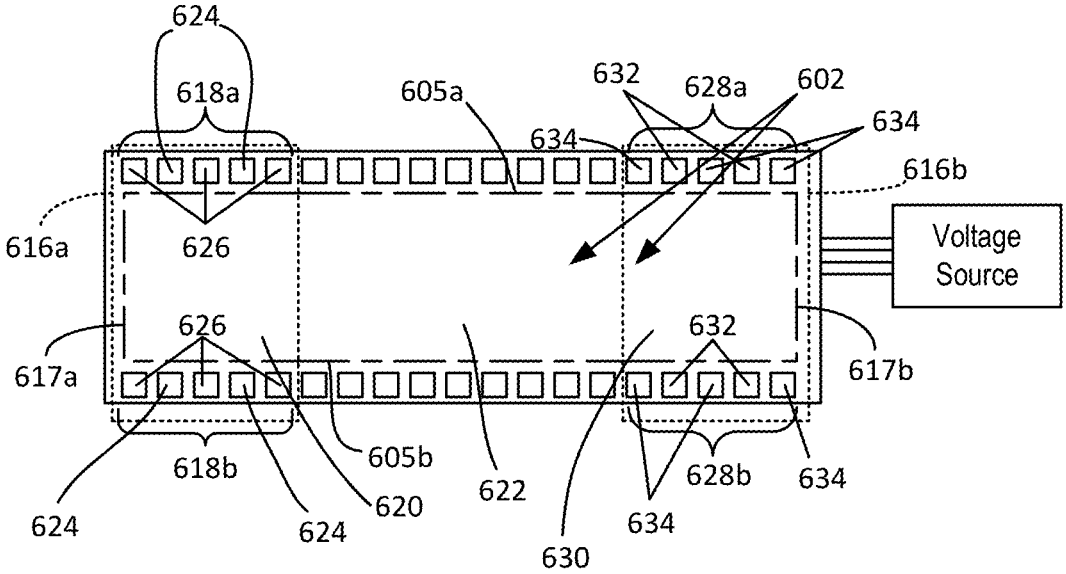
FIG. 6C is an end view of the ion manipulation apparatus example of FIG. 6A.

FIGS. 6A-6C show another example of an ion manipulation apparatus 600 situated to confine ions in a confinement volume 602. A first pair of opposing electrode sets 604*a*, 604*b* is arranged so as to define two opposing boundaries 605*a*, 605*b* of the confinement volume 602. Each of the electrode sets 604*a*, 604*b* includes a plurality of traveling wave electrode sets 606 and RF electrodes 608 that extend between opposing ends 610, 612 of the confinement volume 602. The RF electrodes 608 provide ion confinement between the first pair of electrode sets 604, e.g., in a first lateral confinement direction that is generally perpendicular to a longitudinal ion movement direction between the opposing ends 610, 612. The traveling wave electrode sets 606 provide a DC traveling wave voltage between traveling wave electrodes 614 in each traveling wave electrode set 606 so as to produce a traveling wave electric field that provides the ion movement in the confinement volume 602 between the opposing ends 610, 612, e.g, from the end 610 to the end 612, from the end 612 to the end 610, from one of the ends 610, 612 to become trapped in the confinement volume 602, from one of the ends 610, 612 to become separated into different ion groupings within the confinement volume 602, etc.

A second pair of opposing electrode sets 616*a*, 616*b* is arranged to provide confinement of the ions in the confinement volume 602 between two opposing boundaries 617*a*, 617*b* in a second lateral confinement direction that complements the first lateral confinement direction. In some examples, the second confinement direction can be mutually perpendicular to the first confinement and ion movement directions. In further examples, additional lateral confinement directions complement the first and second lateral confinement directions. The electrode set 616*a* includes a pair of opposing electrode arrangements 618*a*, 618*b* spaced apart across a confinement volume portion 620 adjacent to a center confinement volume portion 622. Each of the opposing electrode arrangements 618*a*, 618*b* includes a plurality of RF electrodes 624 and a plurality of traveling wave electrodes 626 extending between the opposing ends 610, 612. The RF electrodes 624 move ions in the confinement volume portion 620 away from the opposing electrode arrangements 618 and the traveling wave electrodes 626 are situated to move or confine the ions in the second lateral ion confinement direction away from the confinement volume boundary 617*a* and towards the center confinement volume portion 622.

The electrode set 616*b* includes a similar pair of opposing electrode arrangements 628*a*, 628*b* spaced apart across a confinement volume portion 630 adjacent to the center confinement volume portion 622, with each including a plurality of RF electrodes 632 and a plurality of traveling wave electrodes 634. The RF electrodes 632 move ions in the confinement volume portion 622 away from the opposing electrode arrangements 628 and the traveling wave electrodes 634 are situated to move the ions in the second lateral ion confinement direction, away from the confinement volume boundary 617*b* and towards the center confinement volume portion 622. In representative examples, the opposing electrode arrangements 616*a*, 616*b* extend adjacently from the opposing electrode arrangements 604*a*, 604*b* so that the electrodes of the electrode arrangements 604*a*, 618*a*, 628*a* can be associated with a first common surface and the electrodes of the electrode arrangements 604*b*, 618*b*, 628*b* can be associated with a second common surface spaced apart from the first common surface. For example, the first and second common surfaces can be printed circuit boards with electrode arrangements formed on the respective surfaces. In some examples, the traveling wave characteristics, including peak-to-peak voltage, wave speed, duration, etc., are the same for the traveling wave electrodes 626 and the traveling wave electrode sets 606. In additional examples, the traveling wave characteristics can be different, including between the traveling wave electrodes 626, 634. The RF field characteristics associated with the electrodes 608 can be same or different from the RF field characteristics produced by the RF electrodes 624, 632.

Figure 7:
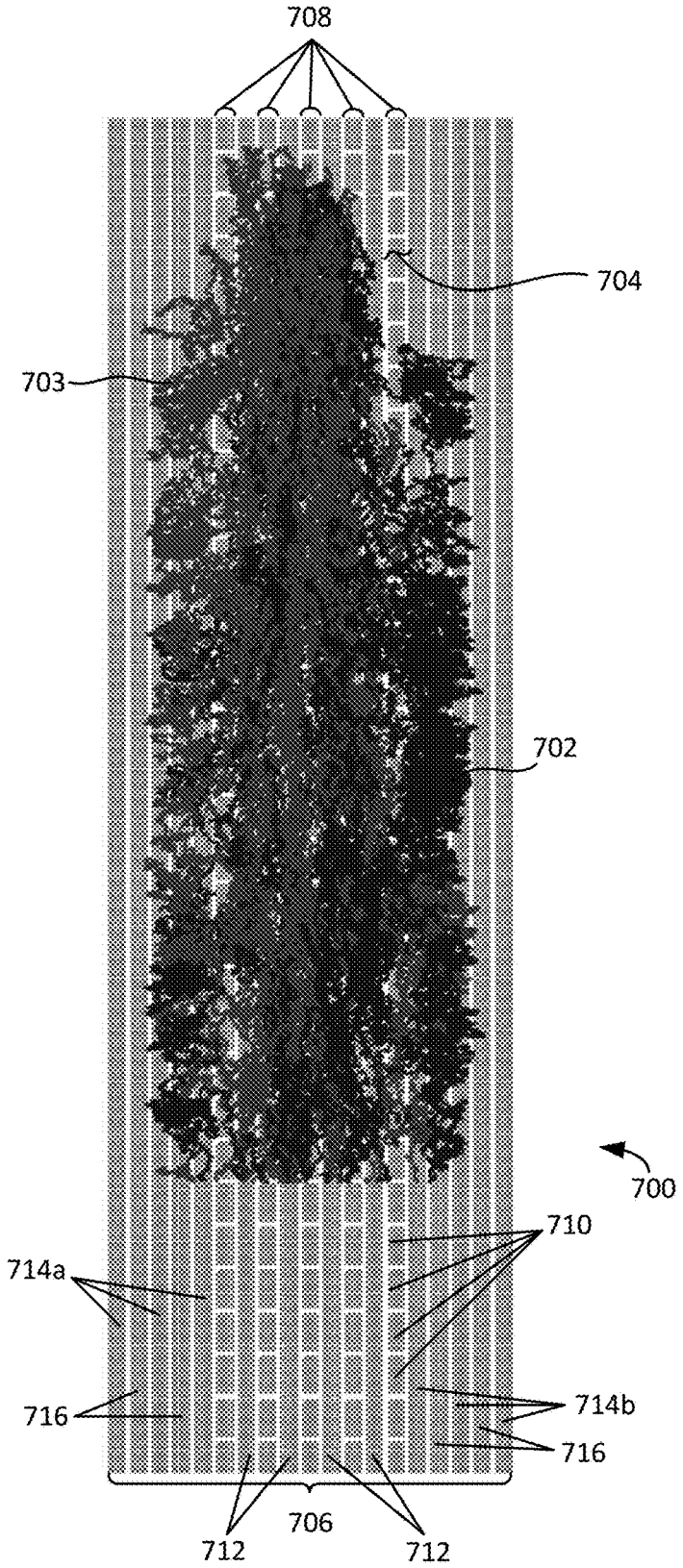
FIG. 7 is a top cross-sectional view of another example ion manipulation apparatus manipulating ions of different polarities.

FIG. 7 shows a top view of an example ion manipulation apparatus 700 that includes a first set of ions (black) 702 having a positive polarity and a second set of ions (dark grey) 703 having a negative polarity as the first set of ions 702, both confined in a confinement volume 704. The confinement volume 704 is defined between a first set of electrodes 706 and a second set of electrodes opposed and spaced apart from the first set of electrodes 706 and which is omitted to show the confined first and second sets of ions 702, 703 in the confinement volume 704. In typical examples the second set of electrodes is a substantial mirror copy of the first set of electrodes 706.

The first set of electrodes 706 includes a plurality of traveling wave electrode sets 708 each including a plurality of traveling wave electrodes 710 extending in a sequence. The traveling wave electrodes 710 are situated to receive separate variable DC voltages corresponding to a traveling wave electric field that travels along the sequence of traveling wave electrodes 710 with predetermined traveling wave characteristics, such as traveling wave speed, amplitude, frequency, crest duration, etc. The traveling wave characteristics associated with the traveling wave electrode sets 708 typically correspond with separation, trapping, or movement of the first and second sets of ions 702, 703 along the direction of the sequences of traveling wave electrodes 710. A plurality of RF electrodes 712 are interposed between the traveling wave electrode sets 708 and inhibit the first and second sets of ions 702, 703 from impinging on the first set of electrodes 706 or otherwise escaping the confinement volume 704 (e.g., between the RF electrodes 712 and traveling wave electrodes 710).

The first set of electrodes 706 further includes a pair of opposing traveling wave electrode sets 714*a*, 714*b*, each including a plurality of traveling wave electrodes 716 that extend along the ion manipulation apparatus 700 similar to the traveling wave electrode sets 708 and RF electrodes 712. The opposing traveling wave electrode sets 714*a*, 714*b* are situated to receive separate variable DC voltages that correspond to a traveling wave electric field that travels in a different direction with respect to the general movement direction of the first and second sets of ions 702, 703 being directed along the length of the traveling wave electrode sets 708, such as perpendicularly. The first set of electrodes 706 further includes a plurality of RF electrodes 716 that inhibit propagation of the first and second sets of ions 702, 703 to the RF electrodes 716 and the opposing traveling wave electrode sets 714*a*, 714*b*. The characteristics of the traveling waves formed by the traveling wave electrode sets 714*a*, 714*b* are selected so as to provide lateral confinement, or guarding, of the first and second sets of ions 702, 703 inside the confinement volume 704 that complements the confinement provided by the RF electrodes 712.

In the example shown, the first and second sets of ions 702, 703 extend into lateral regions 716*a*, 716*b* of the confinement volume 704. The RF electrodes 716 inhibit ion travel to the RF electrodes 716 and traveling wave electrodes sets 714*a*, 714*b* in the corresponding lateral regions 716*a*, 716*b*. The traveling wave characteristics corresponding to the traveling wave electrode sets 708 that move the first and second sets of ions 702, 703 along an ion propagation path include a traveling wave speed of 100 m/s and a symmetric amplitude of ±15 V. The traveling wave characteristics corresponding to the opposing traveling wave electrode sets 714*a*, 714*b* that provide a confinement of the first and second sets of ions 702, 703 within the confinement volume 704 include a traveling wave speed of 30 m/s and a symmetric amplitude of ±20 V.

Figure 8:
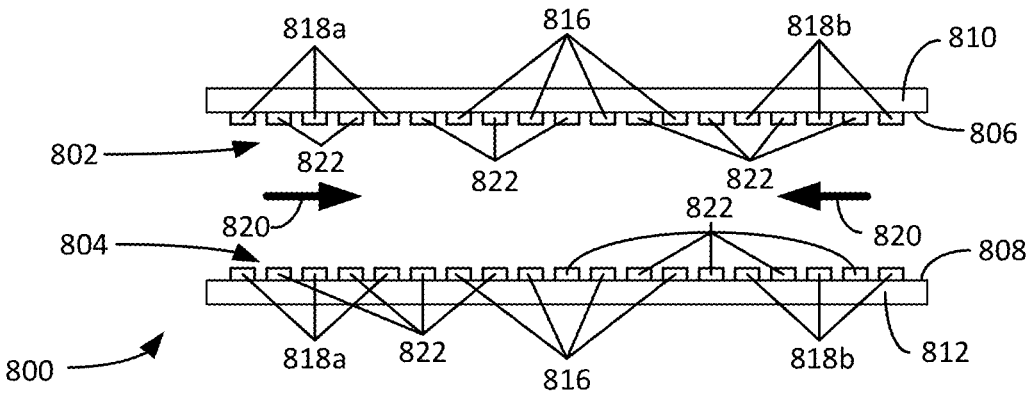
FIGS. 8-10 are end views of additional examples of an ion manipulation apparatus.

FIG. 8 shows an input end of an example ion manipulation apparatus 800 that includes a pair of opposing electrode arrangements 802, 804 situated on respective interior surfaces 806, 808 of housing members 810, 812. Electrodes or electrode sets of the opposing electrode arrangements 802, 804 extend into the plane of FIG. 8 and are situated to confine ions propagating in an ion confinement volume 814 defined between the opposing electrode arrangements 802, 804. Each of the opposing electrode arrangements 802, 804 includes a plurality of traveling wave electrode sets 816 situated to move the ions in the ion confinement volume 814 into the plane of FIG. 8 and a pair of opposing traveling wave electrode sets 818*a*, 818*b* situated to confine the ions in the ion confinement volume 814 through movement in an inward lateral direction, indicated generally by arrows 820. Each of the opposing electrode arrangements 802, 804 also includes a plurality of RF electrodes 822 that confine ions in an inward lateral direction away from the interior surfaces 806, 808. As shown, the inward lateral direction of confinement provided by the RF electrodes is generally perpendicular to the inward lateral direction indicated by the arrows 820, though it will be appreciated that the confinement directions can vary based on the shape of the electrode arrangements, corresponding electric field strengths, ion characteristics (e.g., mobility, polarity, m/z, etc.), confinement volume shape, etc.

Figure 9:
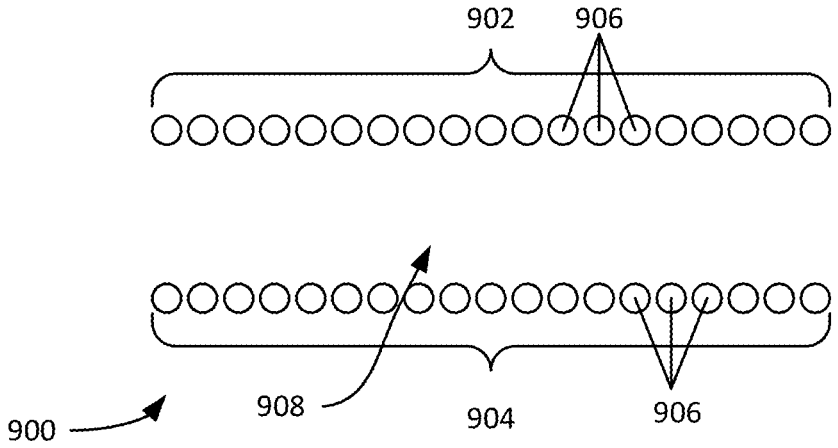
Figure 10:
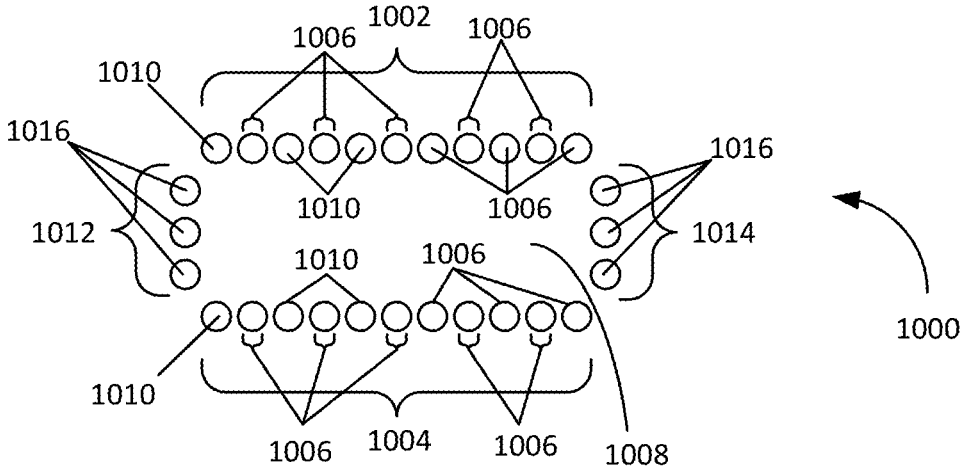

FIG. 9 depicts another example ion manipulation apparatus 900 viewed on-end. The ion manipulation apparatus 900 includes a pair of opposing electrode arrangements 902, 904 each including a plurality of wire electrodes 906 shown, for example, with a circular cross-section. The wire electrodes 906 can include RF electrodes situated to provide confinement of ions propagating in an interior ion confinement volume 908 defined between the opposing electrode arrangements 902, 904 and a plurality of sets of traveling wave electrodes situated to provide confinement of ions propagating in the ion confinement volume 908 or movement of ions in the ion confinement volume 908. FIG. 10 depicts another example ion manipulation apparatus 1000 viewed on-end. A first pair of opposing electrode arrangements 1002, 1004 includes a plurality of traveling wire electrode sets 1006 each including a plurality of wire electrodes and situated across an ion confinement volume 1008. The first pair of opposing electrode arrangements 1002, 1004 further includes a plurality of RF wire electrodes 1010 alternately situated between adjacent traveling electrode sets 1006 and so as to provide confinement of ions between the first pair of opposing electrode arrangements 1002, 1004. A second pair of opposing electrode arrangements 1012, 1014 includes a plurality of adjacent RF wire electrodes 1016 situated to provide ion confinement in the ion confinement volume 1008 between the second pair of opposing electrode arrangements 1012, 1014.

Figure 11:
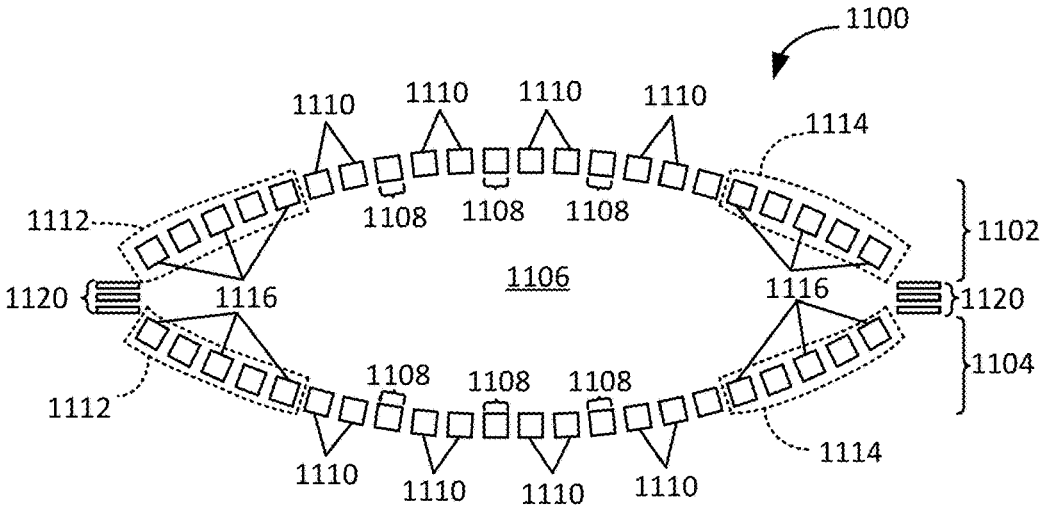
FIG. 11 is an end view of another example ion manipulation apparatus.

In FIG. 11, an example ion manipulation apparatus 1100 is shown which includes a pair of opposing curved electrode arrangements 1102, 1104 extending into the plane of FIG. 11 and spaced apart across a confinement volume 1106. In some examples, the opposing curved electrode arrangements 1102, 1104 include a plurality of traveling wave electrode sets 1108 situated to receive a traveling wave voltages and to move ions confined in the confinement volume 1106 into or out of the plane of FIG. 11. RF electrodes 1110 with an adjacently alternating phase are typically interposed between adjacent traveling wave electrode sets 1108 in order to inhibit ions in the confinement volume 1106 from contacting or reaching the proximity of the RF electrodes 1110 and traveling wave electrode sets 1108 and to confine the ions in the confinement volume 1106.

Each of the opposing curved electrode arrangements 1102, 1104 includes an opposing pair of electrode arrangements 1112, 1114 situated adjacent to the traveling wave electrode sets 1108 and RF electrodes 1110. In some embodiments, the opposing pair of electrode arrangements 1112, 1114 includes a pair of opposing traveling wave electrode sets 1116 situated to direct ions inward into the confinement volume 1106 between the traveling wave electrode sets 1108, so as to complement the confinement provided by the RF electrodes 1110. The opposing pair of electrode arrangements 1112, 1114 also includes a plurality of RF electrodes 1118, which can be similar or the same as the RF electrodes 1110, alternately situated between the traveling wave electrodes of the opposing traveling wave electrode sets 1116. In additional embodiments, the opposing pair of electrode arrangements 1112, 1114 includes a plurality of RF electrodes 1118 in the place of the traveling wave electrodes of the traveling wave electrode sets 1116. In further embodiments, end stacks 1120 of RF electrodes can be situated to further inhibit ions from escaping the confinement volume 1106. In typical examples, adjacent RF electrodes are 180° out of phase.

Figure 12:
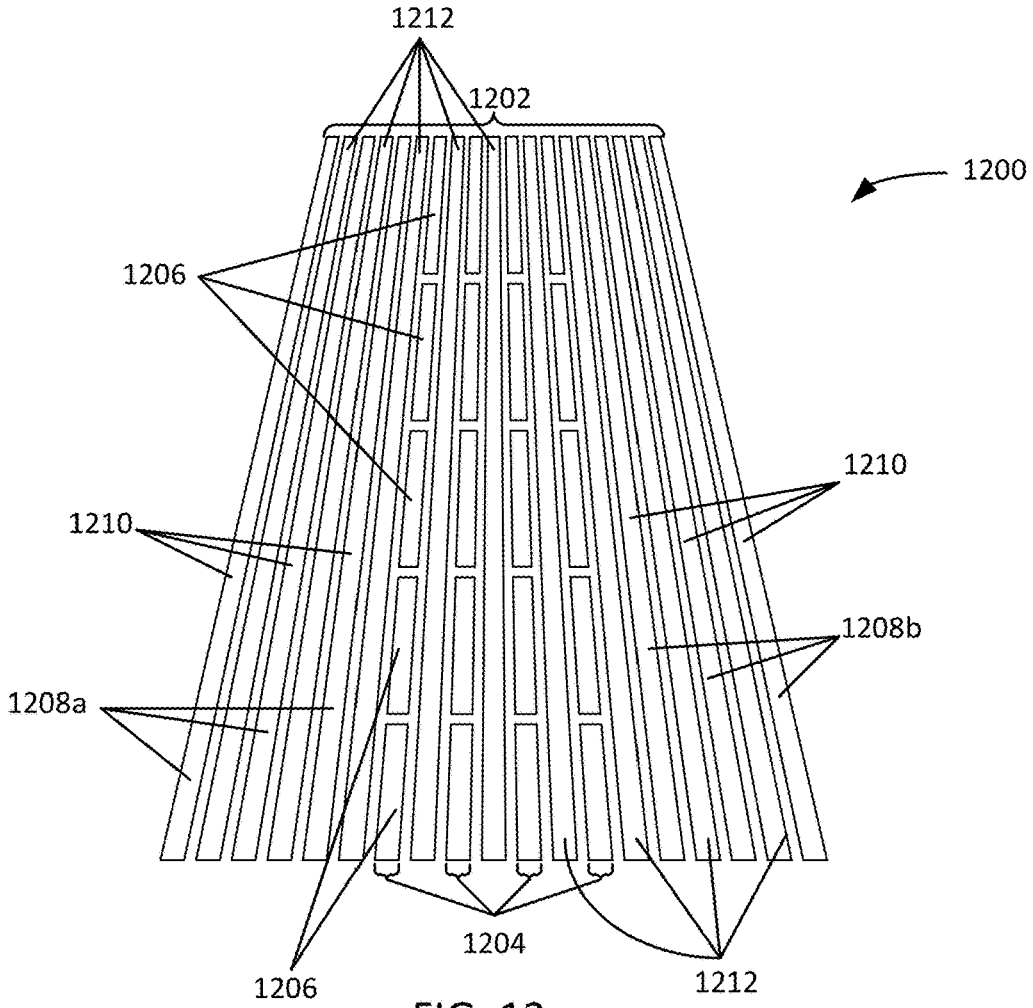
FIG. 12 is a top view of another example ion manipulation apparatus.

In FIG. 12, an example of an ion manipulation apparatus 1200 includes a first tapered electrode arrangement 1202 opposing a second tapered electrode arrangement, which is omitted for clarity in the top view of the apparatus 1200 that is shown. An ion confinement volume, in which ions are separated, trapped, or moved, is defined between the first tapered electrode arrangement 1202 and the second tapered electrode arrangement. In typical examples, the second tapered electrode arrangement substantially mirrors the configuration of the first tapered electrode configuration 1202. The tapered electrode arrangement 1202 includes a plurality of traveling wave electrode arrangements 1204 having sequences of traveling wave electrodes 1206 that taper along the length of the sequences and that produce ion movement in the ion confinement volume in a direction corresponding to the length direction of the electrode sequences. The tapered electrode arrangement 1202 further includes a pair of opposing traveling wave electrode arrangements 1208*a*, 1208*b* having respective sequences of traveling wave electrodes 1210 producing ion movement in a general interior direction, e.g., from left to right in FIG. 12 for traveling wave electrode arrangement 1208*a* and from right to left for traveling wave electrode arrangement 1208*b*. A plurality of interposed RF electrodes 1212 are situated to inhibit ions from contacting the first tapered electrode arrangement 1202 and the second tapered electrode arrangement.

Figure 13:
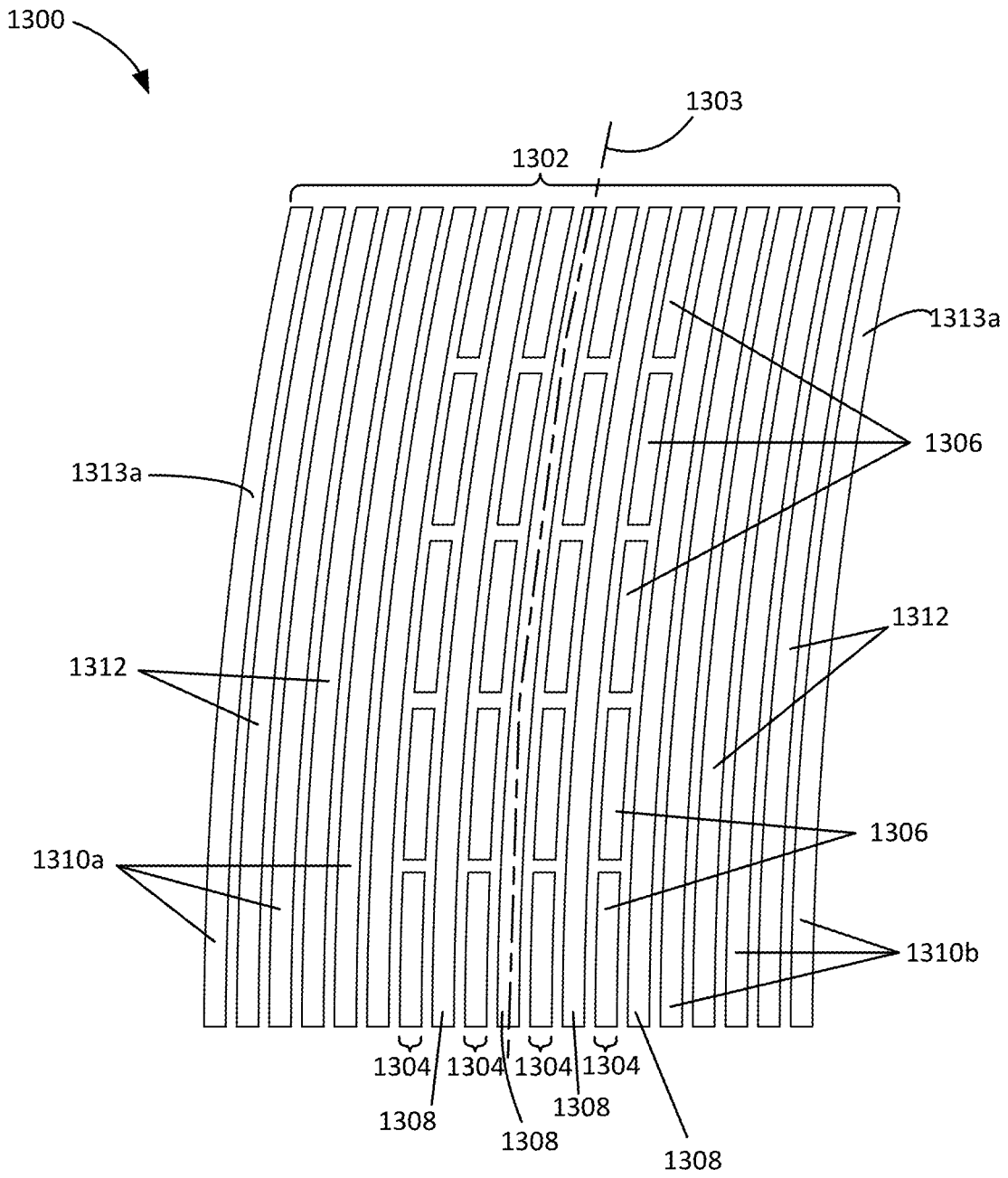
FIG. 13 is a top view of another example ion manipulation apparatus.

FIG. 13 depicts an example ion manipulation apparatus 1300 that includes a first curved electrode arrangement 1302 and a second curved electrode arrangement (not shown) opposing and spaced apart from the first curved electrode arrangement 1302 to form an ion confinement volume extending along a curved axis 1303. A plurality of curved traveling wave electrode sequences 1304 include traveling wave electrodes 1306 situated to receive a DC traveling wave voltage to produce a movement of the ions along the curved shape of the ion confinement volume. In some examples, the traveling wave electrodes 1306 can be linear segments forming a piece-wise curved shape. A plurality of RF electrodes 1308 are situated between adjacent traveling wave electrode sequences 1304. In some examples, an opposing pair of traveling wave electrodes sets 1310*a*, 1310*b* are situated to direct ions in an inward lateral direction, e.g., generally normal or perpendicular to a tangent of the curved axis 1303, so as to provide confinement, separation, or trapping of ions within the ion confinement volume. A plurality of RF electrodes 1312 are situated between the electrodes of the traveling wave electrode sets 1310*a*, 1310*b* and are situated to receive an RF voltage so as to inhibit contact of ions with the RF electrodes 1312, the electrode sets 1310*a*, 1310*b*, or corresponding surfaces on which the RF electrodes 1312 and electrode sets 1310*a*, 1310*b* may be mounted, formed, or otherwise situated. In some examples, end stacks of RF electrodes 1312 can extend into or out of the plane from edge electrodes 1313*a*, 1313*b* so as to provide additional confinement of ions within the ion confinement volume in the inward lateral direction, e.g., generally perpendicular to the curved axis 1303. In further examples with end stacks of RF electrodes 1312 the traveling wave electrode sets 1310*a*, 1310*b* can be omitted.

Figure 14:
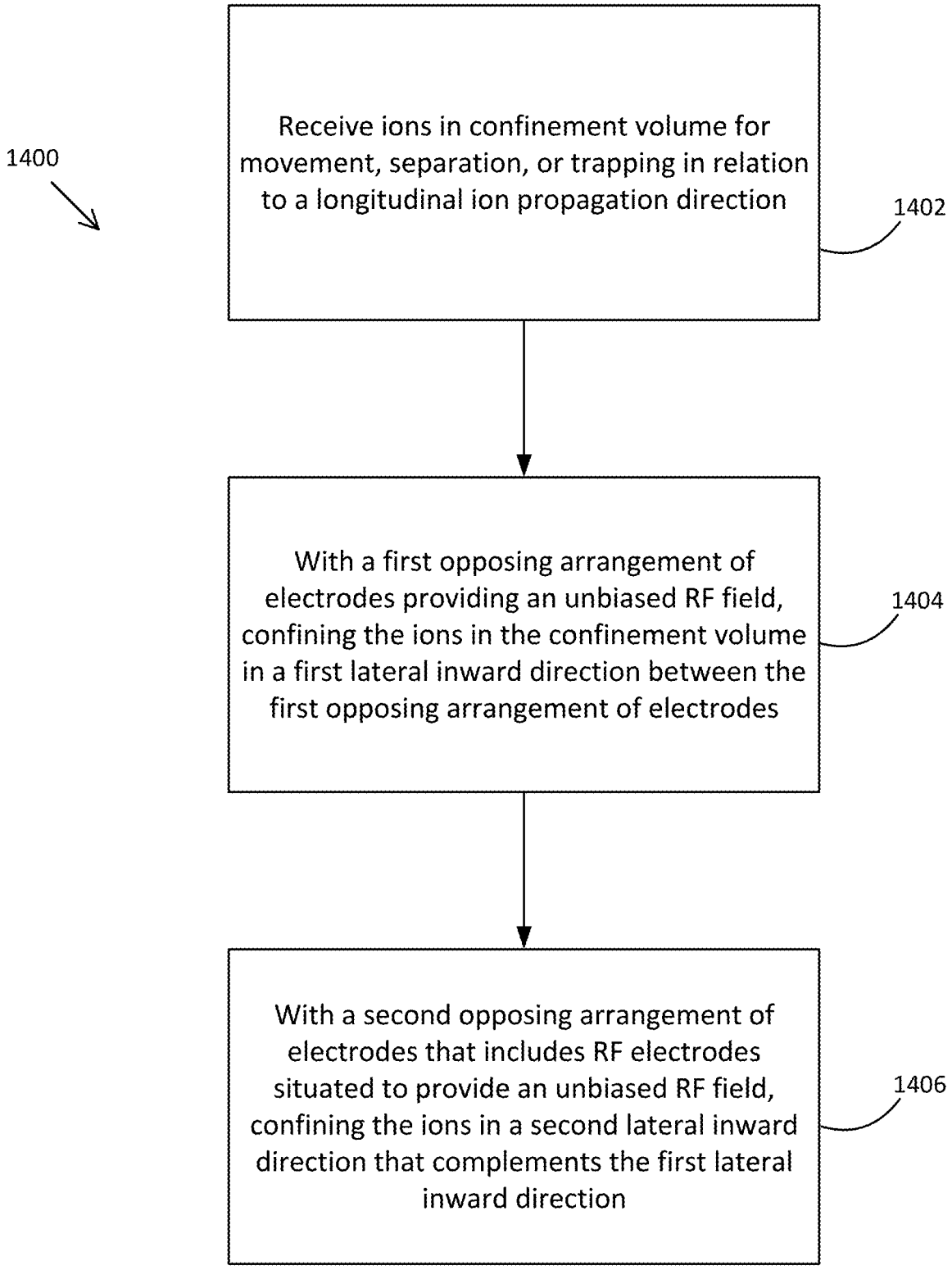
FIG. 14 is a flowchart of an example method in accordance with the disclosed technology.

In FIG. 14, a flowchart shows an example method 1400 for manipulating ions, including ions of the same or different ion polarities. In a method act 1402, ions are received in a confinement volume to move the ions, including through transport, separation, trapping, etc., in relation to a longitudinal ion propagation direction. In a method act 1404, with a first opposing arrangement of electrodes providing an unbiased RF field, ions are confined in the confinement volume in a first lateral inward direction between the first opposing arrangements of electrodes. In some examples, the first inward direction is perpendicular or normal to the ion propagation direction. In a method act 1406, with a second opposing arrangement of electrodes that includes RF electrodes situated to provide an unbiased RF field, ions are confined in a second inward lateral direction that complements the first lateral inward direction. The ions become confined ions between the first and second arrangements of electrodes within the ion confinement volume for lossless propagation of the ions. In particular examples, the second inward direction of confinement is mutually perpendicular to the ion propagation direction and the first inward direction.

In representative examples, the confining of ions in the second inward direction includes providing an unbiased RF voltage to a pair of opposing arrangements of RF electrodes of the second opposing arrangement of electrodes so as to provide the unbiased RF field, each opposing arrangement forming a stack with adjacent RF electrodes of the stack having an alternate phase, each RF electrode extending along the ion propagation direction so as to provide the confining of the ions in the second inward direction. In other representative examples, the confining of the ions in the second inward direction includes providing an unbiased RF voltage to RF electrodes of a pair of opposing arrangements of electrodes of the second opposing arrangement of electrodes so as to provide the unbiased RF field and ion confinement in the first inward direction in an extended confinement region of the confinement volume and includes providing a variable DC voltage to traveling wave electrodes of the pair of opposing arrangements of electrodes that are alternately arranged between the RF electrodes of the pair of opposing arrangements of electrodes so as to produce a corresponding traveling wave to move the ions in the extended confinement region in the second inward direction.

In view of the many possible embodiments to which the principles of the disclosed technology may be applied, it should be recognized that the illustrated embodiments are only representative examples and should not be taken as limiting the scope of the disclosure. Alternatives specifically addressed in these sections are merely exemplary and do not constitute all possible alternatives to the embodiments described herein. For instance, various components of systems described herein may be combined in function and use. We therefore claim all that comes within the scope and spirit of the appended claims.

We claim:

1. An apparatus, comprising:

a first pair of opposing electrode arrangements configured to confine received ions between the first pair opposing electrode arrangements in a confinement volume portion of a confinement volume inwardly laterally in a first confinement direction with respect to a longitudinal ion propagation direction, each opposing electrode arrangement of the first pair including an arrangement of RF electrodes configured to receive an unbiased RF voltage having an alternate phase between adjacent RF electrodes of the arrangement of RF electrodes of the opposing electrode arrangement of the first pair to confine received ions between the first pair of opposing electrode arrangements, wherein the RF electrodes of the first pair of opposing electrode arrangements extend along the confinement volume in the longitudinal ion propagation direction; and a second pair of opposing electrode arrangements separate from the first pair of opposing electrode arrangements and configured to confine ions received between the second pair of opposing electrode arrangements in the confinement volume inwardly laterally in a second confinement direction that complements the first confinement direction, each opposing electrode arrangement of the second pair including an arrangement of RF electrodes configured to receive an unbiased RF voltage having an alternate phase between adjacent RF electrodes of the arrangement of RF electrodes of the opposing electrode arrangement of the second pair;

wherein the first and second pairs of opposing electrode arrangements are configured to concurrently confine and move received ions of opposite polarities in the confinement volume and along the longitudinal ion propagation direction.

2. The apparatus of claim 1, wherein the first and second ion confinement directions are mutually perpendicular to the ion propagation direction.

3. The apparatus of claim 1, wherein RF electrodes of each arrangement of RF electrodes of the second pair of opposing electrode arrangements are stacked in a direction laterally to the second confinement direction, extend longitudinally along the ion propagation direction confinement volume, and provide confinement of the received ions in the second confinement direction.

4. The apparatus of claim 3, wherein each of the stacked RF electrodes includes one or more substantially planar surfaces extending laterally in the second confinement direction.

5. The apparatus of claim 3, wherein the RF electrodes are wire electrodes.

6. The apparatus of claim 3, wherein the RF electrodes of the second pair of opposing electrode arrangements are arranged to define the confinement volume portion with a non-rectangular confinement cross-section.

7. The apparatus of claim 1, wherein the confinement volume defines an first ion conduit and the apparatus further comprises a second ion conduit spaced apart from the first ion conduit and wherein the second ion conduit includes a plurality of electrode arrangements and at least one the electrode arrangements is an opposing electrode arrangement of the first or second pairs of opposing electrode arrangements.

8. The apparatus of claim 1, wherein the alternate phase between adjacent RF electrodes is 180 degrees out of phase.

9. The apparatus of claim 1, wherein the confinement volume is curved or tapered.

10. An apparatus, comprising:

a first pair of opposing electrode arrangements configured to confine received ions between the first pair opposing electrode arrangements in a confinement volume portion of a confinement volume inwardly laterally in a first confinement direction with respect to a longitudinal ion propagation direction, each opposing electrode arrangement of the first pair including an arrangement of RF electrodes configured to receive an unbiased RF voltage having an alternate phase between adjacent RF electrodes of the arrangement of RF electrodes of the opposing electrode arrangement of the first pair to confine received ions between the first pair of opposing electrode arrangements, wherein the RF electrodes of the first pair of opposing electrode arrangements extend along the confinement volume in the longitudinal ion propagation direction;

a second pair of opposing electrode arrangements separate from the first pair of opposing electrode arrangements and configured to confine ions received between the second pair of opposing electrode arrangements in the confinement volume inwardly laterally in a second confinement direction that complements the first confinement direction, each opposing electrode arrangement of the second pair including an arrangement of RF electrodes configured to receive an unbiased RF voltage having an alternate phase between adjacent RF electrodes of the arrangement of RF electrodes of the opposing electrode arrangement of the second pair; wherein the first and second pairs of opposing electrode arrangements are configured to concurrently confine received ions of opposite polarities in the confinement volume; and a traveling wave electrode arrangement situated between adjacent RF electrodes of the first pair of opposing electrode arrangements and that includes a plurality of traveling wave electrodes extending in a longitudinal sequence in the ion propagation direction and configured to receive a variable DC voltage.

11. An apparatus, comprising:

a first pair of opposing electrode arrangements configured to confine received ions between the first pair opposing electrode arrangements in a confinement volume portion of a confinement volume inwardly laterally in a first confinement direction with respect to a longitudinal ion propagation direction, each opposing electrode arrangement of the first pair including an arrangement of RF electrodes configured to receive an unbiased RF voltage having an alternate phase between adjacent RF electrodes of the arrangement of RF electrodes of the opposing electrode arrangement of the first pair to confine received ions between the first pair of opposing electrode arrangements, wherein the RF electrodes of the first pair of opposing electrode arrangements extend along the confinement volume in the longitudinal ion propagation direction; and a second pair of opposing electrode arrangements separate from the first pair of opposing electrode arrangements and configured to confine ions received between the second pair of opposing electrode arrangements in the confinement volume inwardly laterally in a second confinement direction that complements the first confinement direction, each opposing electrode arrangement of the second pair including an arrangement of RF electrodes configured to receive an unbiased RF voltage having an alternate phase between adjacent RF electrodes of the arrangement of RF electrodes of the opposing electrode arrangement of the second pair; wherein the first and second pairs of opposing electrode arrangements are configured to concurrently confine received ions of opposite polarities in the confinement volume;

wherein the first and second pairs of opposing electrode arrangements are configured to separate the ions of opposite polarities laterally into different respective volumes in the confinement volume portion.

12. An apparatus, comprising:

a first pair of opposing electrode arrangements configured to confine received ions between the first pair opposing electrode arrangements in a confinement volume portion of a confinement volume inwardly laterally in a first confinement direction with respect to a longitudinal ion propagation direction, each opposing electrode arrangement of the first pair including an arrangement of RF electrodes configured to receive an unbiased RF voltage having an alternate phase between adjacent RF electrodes of the arrangement of RF electrodes of the opposing electrode arrangement of the first pair to confine received ions between the first pair of opposing electrode arrangements, wherein the RF electrodes of the first pair of opposing electrode arrangements extend along the confinement volume in the longitudinal ion propagation direction; and a second pair of opposing electrode arrangements separate from the first pair of opposing electrode arrangements and configured to confine ions received between the second pair of opposing electrode arrangements in the confinement volume inwardly laterally in a second confinement direction that complements the first confinement direction, each opposing electrode arrangement of the second pair including an arrangement of RF electrodes configured to receive an unbiased RF voltage having an alternate phase between adjacent RF electrodes of the arrangement of RF electrodes of the opposing electrode arrangement of the second pair; wherein the first and second pairs of opposing electrode arrangements are configured to concurrently confine received ions of opposite polarities in the confinement volume;

wherein each opposing electrode arrangement of the second pair includes a traveling wave electrode arrangement configured to confine the received ions in the confinement volume in the second confinement direction.

13. The apparatus of claim 12, wherein each traveling wave electrode arrangement includes a plurality of traveling wave electrodes extending longitudinally in the ion propagation direction and spaced apart from each other in the second confinement direction, wherein the traveling wave electrodes are configured to receive a variable DC voltage and to produce a corresponding traveling wave to confine the received ions in the confinement volume in the second confinement direction.

14. The apparatus of claim 12, wherein the traveling wave electrode arrangements are configured to confine the received ions in an extended confinement volume portion of the confinement volume that is laterally adjacent to the confinement volume portion.

15. The apparatus of claim 13, wherein the RF electrodes of the second pair of opposing electrode arrangements extend longitudinally in the ion propagation direction and are spaced apart from each other in the second confinement direction.

16. The apparatus of claim 15, wherein the traveling wave electrodes are situated between adjacent RF electrodes of the second pair of opposing electrode arrangements.

17. The apparatus of claim 14, wherein the first and second pairs of opposing electrode arrangements are situated on opposing surfaces defining an electrodeless gap that includes the confinement volume portion and the extended confinement volume portion.

18. The apparatus of claim 12, further comprising a second traveling wave electrode arrangement situated between adjacent RF electrodes of the first pair of opposing electrode arrangements, wherein the second traveling wave electrode arrangement includes a plurality of traveling wave electrodes extending in a longitudinal sequence with respect to the ion propagation direction, wherein the traveling wave electrodes receive a variable DC voltage configured to produce a corresponding traveling wave to manipulate movement of the received ions within the confinement volume.

19. A method, comprising:

on a first printed circuit board, forming a first pair of opposing electrode arrangements configured to confine received ions between the first pair opposing electrode arrangements in a confinement volume portion of a confinement volume inwardly laterally in a first confinement direction with respect to a longitudinal ion propagation direction, each opposing electrode arrangement of the first pair including an arrangement of RF electrodes configured to receive an unbiased RF voltage having an alternate phase between adjacent RF electrodes of the arrangement of RF electrodes of the opposing electrode arrangement of the first pair to confine received ions between the first pair of opposing electrode arrangements, wherein the RF electrodes of the first pair of opposing electrode arrangements extend along the confinement volume in the longitudinal ion propagation direction; and on a second printed circuit board, forming a second pair of opposing electrode arrangements separate from the first pair of opposing electrode arrangements and configured to confine ions received between the second pair of opposing electrode arrangements in the confinement volume inwardly laterally in a second confinement direction that complements the first confinement direction, each opposing electrode arrangement of the second pair including an arrangement of RF electrodes configured to receive an unbiased RF voltage having an alternate phase between adjacent RF electrodes of the arrangement of RF electrodes of the opposing electrode arrangement of the second pair;

wherein the first and second pairs of opposing electrode arrangements are configured to concurrently confine and move received ions of opposite polarities in the confinement volume and along the longitudinal ion propagation direction.

* * * * *